US007681623B2

(12) United States Patent
Janssen

(10) Patent No.: US 7,681,623 B2
(45) Date of Patent: Mar. 23, 2010

(54) CASTING PROCESS AND CAST COMPONENT

(75) Inventor: Stefan Janssen, Essen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/667,575

(22) PCT Filed: Nov. 4, 2005

(86) PCT No.: PCT/EP2005/055766

§ 371 (c)(1),
(2), (4) Date: May 11, 2007

(87) PCT Pub. No.: WO2006/053838

PCT Pub. Date: May 26, 2006

(65) Prior Publication Data

US 2007/0295471 A1 Dec. 27, 2007

(30) Foreign Application Priority Data

Nov. 19, 2004 (EP) ..... 04027556

(51) Int. Cl.
*B22D 19/00* (2006.01)
*B22D 27/04* (2006.01)

(52) U.S. Cl. ..... 164/98; 164/122

(58) Field of Classification Search ..... 164/98, 164/100, 105, 80, 122, 122.1, 122.2
See application file for complete search history.

(56) References Cited

U.S. PATENT DOCUMENTS 3,726,331 A 4/1973 Bunting, Jr.
4,611,791 A * 9/1986 Coble ..... 266/263
4,807,728 A 2/1989 Suenaga et al.
4,817,859 A * 4/1989 Breitenmoser et al. ..... 228/226
5,314,000 A 5/1994 Wang et al.
5,522,448 A * 6/1996 Righi ..... 164/122
5,673,745 A * 10/1997 Jackson et al. ..... 164/80
6,024,792 A 2/2000 Kurz et al.
6,109,334 A * 8/2000 Phipps ..... 164/103
6,253,829 B1 7/2001 Mashiko et al.
6,800,148 B2 * 10/2004 Frasier et al. ..... 148/404
6,908,288 B2 * 6/2005 Jackson et al. ..... 416/224

FOREIGN PATENT DOCUMENTS

| | | |
|---|---|---|
| EP | 0 412 397 | 2/1991 |
| EP | 0 486 489 B1 | 11/1994 |
| EP | 0 786 017 B1 | 7/1997 |
| EP | 0 892 090 A1 | 1/1999 |
| EP | 1 013 781 A2 | 6/2000 |
| EP | 1 204 776 B1 | 5/2002 |
| EP | 1 306 454 A1 | 5/2003 |
| EP | 1 319 729 A1 | 6/2003 |
| JP | 62250125 A | 10/1987 |
| WO | WO 99/67435 | 12/1999 |
| WO | WO 00/44949 | 8/2000 |

* cited by examiner

*Primary Examiner*—Kevin P Kerns

(57) ABSTRACT

Thick-walled parts made via a casting method often exhibit, in those thick zones, the worst mechanical properties since the solidification speed in the zones is reduced relative to the thin-walled zone and frequently induces the worst mechanical properties. There is described a method incorporating solidification control elements in a melting charge, the elements increase locally the solidification speed of the melting charge.

11 Claims, 6 Drawing Sheets

CASTING PROCESS AND CAST COMPONENT

CROSS REFERENCE TO RELATED APPLICATIONS

This application is the US National Stage of International Application No. PCT/EP2005/055766, filed Nov. 4, 2005 and claims the benefit thereof. The International Application claims the benefits of European application No. 04027556.2 EP filed Nov. 19, 2004, both of the applications are incorporated by reference herein in their entirety.

FIELD OF INVENTION

The invention relates to a casting process.

BACKGROUND OF INVENTION

Nowadays, complex casting processes can be successfully managed using modern modeling and simulation tools for casting solidification. This allows better and targeted setting of microstructures and properties. For critical component regions, better mechanical properties can be set with a higher reproducibility in the casting process. For thick-walled regions of cast components, for example in flange regions of housings for gas turbines or steam turbines, it is difficult in casting processes to set the homogenous globular microstructure, which may be required by way of example, during the graphite formation. This is because of the poor dissipation of heat and solidification energy. The result is a drop in the mechanical characteristic values as the wall thickness of these highly stressed component regions increases.

U.S. Pat. No. 5,314,000 discloses a process for controlling the grain size during a casting process.

SUMMARY OF INVENTION

Therefore, it is an object of the invention to overcome the abovementioned problem.

This object is achieved by the casting process as claimed in the independent claims.

The subclaims list further advantageous measures which can be combined with one another in any desired, advantageous way.

DETAILED DESCRIPTION OF INVENTION

Figure 1:
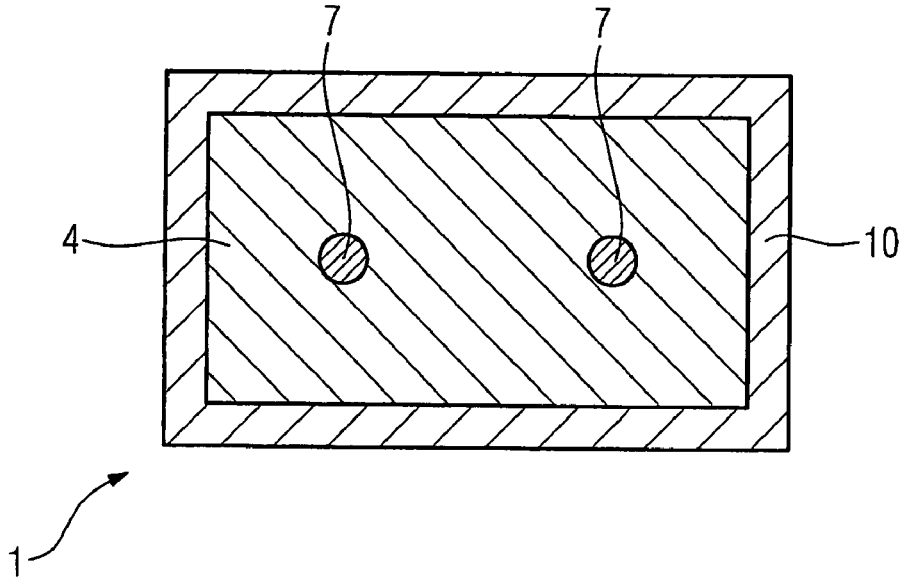
FIG. 1 shows a casting mold together with melt and solidification control Elements.

FIG. 1 illustrates an apparatus 1 comprising a casting mold 10 with a melt 4 and at least one, and in this case for example two, solidification control elements 7. The melt 4 is introduced into the casting mold 10. At least one or a plurality of, in this case for example two, solidification control elements 7 are introduced into the casting mold 10 either before, during or after the introduction of the melt 4. The solidification control elements 7 consist in particular of an identical material to the melt 4. It is also possible for the material of the solidification control elements 7 to be of a similar type to the material of the melt 4, i.e. the solidification control element 7 includes all the elements of the melt 4 but with deviations in respect of the individual elements, in particular to an extent of ±20% and in particular ±10% for the individual elements (at least of similar type means of similar type or identical). It is preferable for the solidification control element 7 to contain the chemical alloying elements of the melt 4. In the abovementioned examples, it is also possible for elements of the melt 4 with low contents by weight (<5 wt %, in particular <1 wt %) not to be present in the material of the solidification control elements 7. The solidification control element 7 preferably consists of the chemical alloying elements of the melt 4. The melting temperature of the solidification control elements 7 may therefore be less than, equal to or greater than the melting temperature of the material of the melt 4. The solidification control elements 7 may therefore be metallic, ceramic or made from glass.

The temperature of the solidification control elements 7 can be preset before they come into contact with the melt 4. This can be achieved by heating or cooling as required. It is also possible for the solidification control elements 7 to be actively cooled, by a coolant being passed for example through the solidification control elements 7 or being brought into contact with at least one solidification control element 7 at one end, so as to impose forced cooling. The solidification control elements 7 are not yet melted at the outset. In particular, the solidification control elements 7 may but need not be at least partially or completely melted after they have come into contact with the melt 4, during the liquid phase of the melt 4 (i.e. the phase in which the melt is present) or during the solidification of the melt 4. It is preferable for the solidification control elements 7 to be at most partially melted, i.e. part of the solidification control elements 7 does not melt.

The solidification control elements 7 are not made from the same material as the casting mold 10, but rather are used for the additional dissipation of heat from the melt. The solidification control elements 7 are therefore also not casting cores. After solidification, their material forms an integral part of the cast component 13. The solidification control elements 7 are in particular a solid crystalline body and are not, as in the case of a casting mold used in a casting process, composed of individual grains (sand mold) which are joined together for example by a binder. The solidification control element 7 is for example a sintered body comprising a large number of grains.

The casting process according to the invention therefore does not constitute an injection-molding process in which a molten or soft material is injection-molded around another material.

The solidification control elements 7 may be of identical or different sizes.

The solidification control elements 7 are of elongate shape and are in particular symmetrical, in particular cylindrical, in form.

A component 13 which is produced by the casting process may for example represent a component of a steam turbine 300, 303 or a gas turbine 100 for an aircraft or for power generation, in which case it then in particular represents a housing component.

In this case, high-grade steels or nickel-, cobalt-, or iron-base superalloys are used.

Figure 2A:
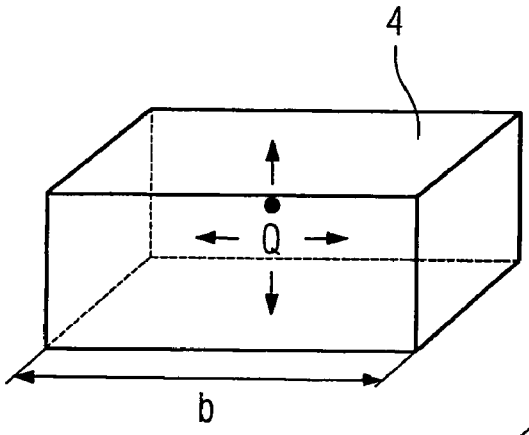
FIG. 2 shows the operating principle of the process according to the invention.

FIGS. 2*a, b* diagrammatically depict the way in which the casting process according to the invention works.

FIG. 2*a* illustrates a for example cuboidal wall element of a component in a casting process according to the prior art. The dissipation of thermal energy over time dQ/dt is denoted here by $\dot{Q}$. In particular in the case of thick-walled components with a considerable width b, it takes a very long time before the melt 4 has cooled, i.e. $\dot{Q}=0$.

Figure 2B:
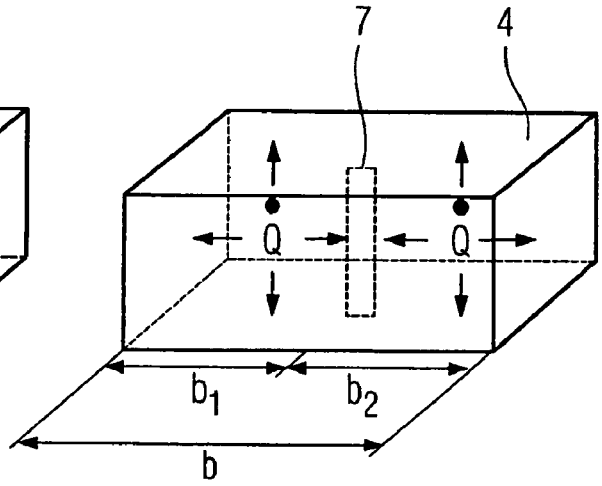

FIG. 2*b* illustrates the corresponding solidification control element 7 in a casting process according to the invention, in which for example a solidification control element 7 is present in the melt 4. As a result of the solidification control element 7 being at a lower temperature than the melting temperature, the solidification control element 7 absorbs heat, or if the solidification control element 7 even melts, it also withdraws melting energy from the melt 4. This increases the cooling rate of the melt, i.e. $\dot{Q}$ is significantly higher. This prevents slower solidification, which often leads to graphite degeneration or to porosity and voids, from occurring in relatively thick regions and thick components. The introduction of solidification control elements 7 into the melt 4 for example results in a homogenous modular graphite formation, in particular in the case of gray cast iron parts. The width b, i.e. the extent of the melt 4, is in effect divided into two smaller widths b1, b2 (b1+b1=b) and the desired cooling properties of thin-walled (b1, b2) walls manifest themselves within the widths b1, b2, which are thin.

Figure 3:
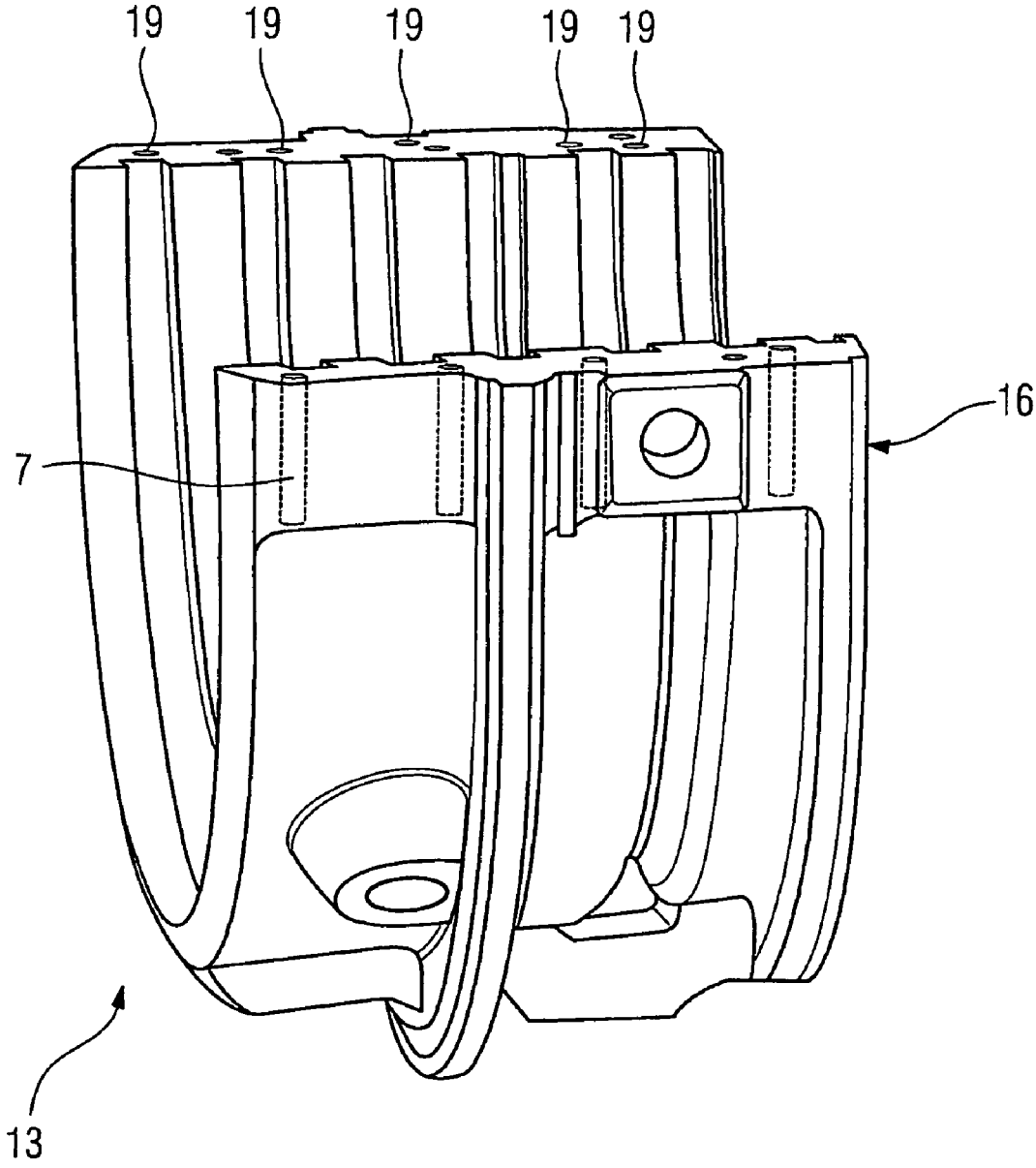
FIG. 3 shows a component which is produced using the process according to the invention.

FIG. 3 shows a cast component 13 according to the invention.

The component 13 has been formed from a melt 4 and includes the solidification control elements 7, which are surrounded by the solidified melt 4. The solidification control elements 7 have in this case been introduced for example in a thick-walled region 16 of the component 13. Such thick-walled regions 16, constitute for example the flanges of a housing part. In this context, the term thick is to be understood as meaning a wall thickness of at least 200 mm. It is preferable for the solidification control elements 7 to be introduced at a location where holes 19 are subsequently introduced into the flange 16, i.e. where material is removed. This reduces the risk of defects being introduced into the component as a result of bonding defects or inadequate melting of the solidification control elements 7, since these regions are in any case removed during the subsequent machining of the component. The solidification control elements 7 do not form part of the casting mold 10 and are for example metallic but may also be ceramic or vitreous.

Figure 4:
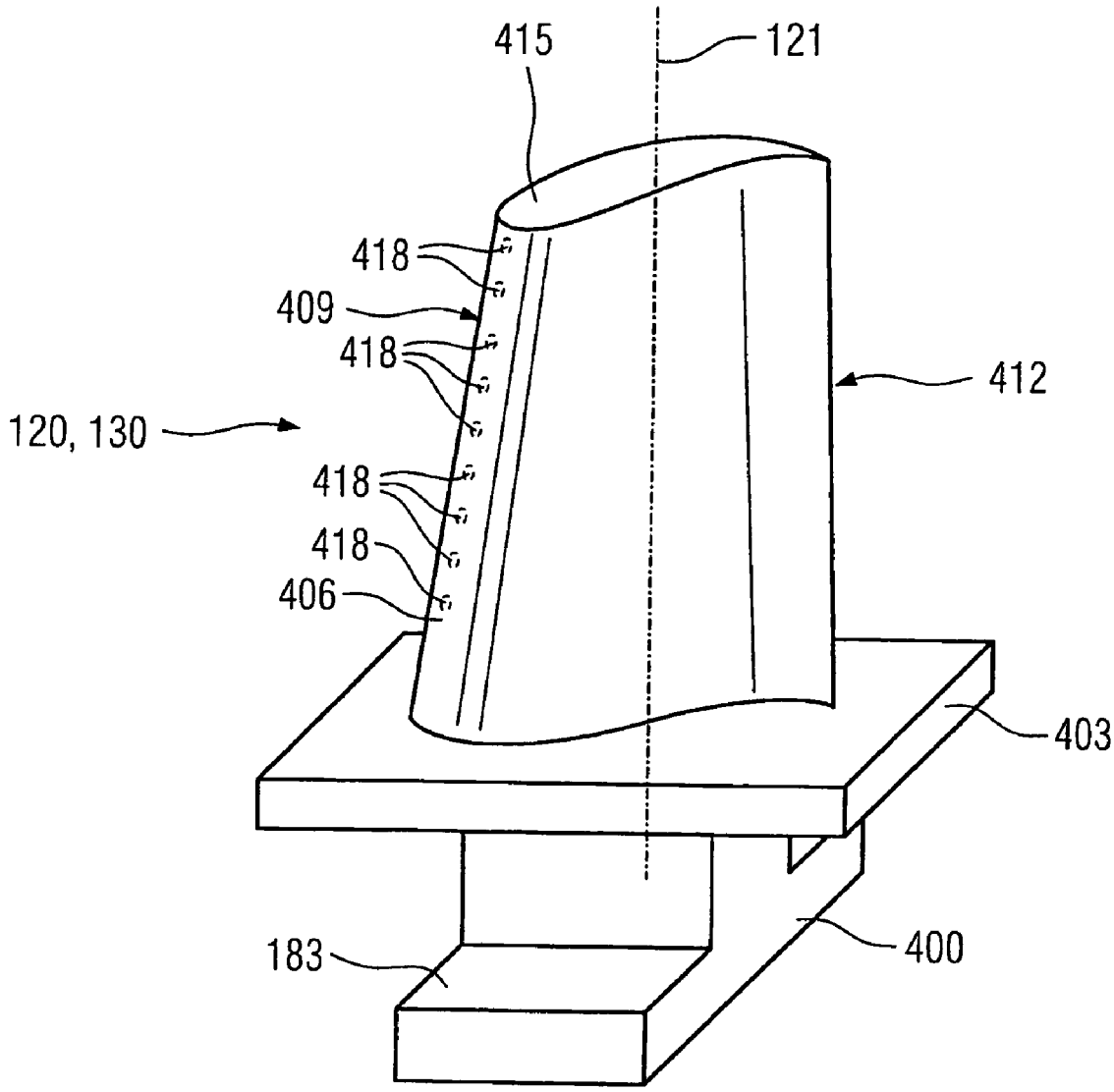
FIG. 4 shows a turbine blade or vane.

FIG. 4 shows a perspective view of a rotor blade 120 or guide vane 130 of a turbomachine, which extends along a longitudinal axis 121.

The turbomachine may be a gas turbine of an aircraft or of a power plant for generating electricity, a steam turbine or a compressor.

The blade or vane 120, 130 has, in succession along the longitudinal axis 121, a securing region 400, an adjoining blade or vane platform 403 and a main blade or vane part 406. As a guide vane 130, the vane 130 may have a further platform (not shown) at its vane tip 415.

A blade or vane root 183, which has, for example, thick-walled regions 16 and is used to secure the rotor blades 120, 130 to a shaft or a disk (not shown), is formed in the securing region 400. The blade or vane root 183 is designed, for example, in hammerhead form. Other configurations, such as a fir-tree or dovetail root, are possible.

The blade or vane 120, 130 has a leading edge 409 and a trailing edge 412 for a medium which flows past the main blade or vane part 406.

In the case of conventional blades or vanes 120, 130, by way of example solid metallic materials, in particular superalloys, are used in all regions 400, 403, 406 of the blade or vane 120, 130. Superalloys of this type are known, for example, from EP 1 204 776 B1, EP 1 306 454, EP 1 319 729 A1, WO 99/67435 or WO 00/44949; these documents form part of the disclosure. The blade or vane 120, 130 may in this case be produced by a casting process, also by means of directional solidification, by a forging process, by a milling process or combinations thereof.

Workpieces with a single-crystal structure or structures are used as components for machines which, in operation, are exposed to high mechanical, thermal and/or chemical stresses. Single-crystal workpieces of this type are produced, for example, by directional solidification from the melt. This involves casting processes in which the liquid metallic alloy solidifies to form the single-crystal structure, i.e. the single-crystal workpiece, or solidifies directionally. In this case, dendritic crystals are oriented along the direction of heat flow and form either a columnar crystalline grain structure (i.e. grains which run over the entire length of the workpiece and are referred to here, in accordance with the language customarily used, as directionally solidified) or a single-crystal structure, i.e. the entire workpiece consists of one single crystal. In these processes, a transition to globular (polycrystalline) solidification needs to be avoided, since non-directional growth inevitably forms transverse and longitudinal grain boundaries, which negate the favorable properties of the directionally solidified or single-crystal component.

Where the text refers in general terms to directionally solidified microstructures, this is to be understood as meaning both single crystals, which do not have any grain boundaries or at most have small-angle grain boundaries, and columnar crystal structures, which do have grain boundaries running in the longitudinal direction but do not have any transverse grain boundaries. This second form of crystalline structures is also described as directionally solidified microstructures (directionally solidified structures). Processes of this type are known from U.S. Pat. No. 6,024,792 and EP 0 892 090 A1; these documents form part of the disclosure.

The blades or vanes 120, 130 may likewise have coatings protecting against corrosion or oxidation (MCrAlX; M is at least one element selected from the group consisting of iron (Fe), cobalt (Co), nickel (Ni), X is an active element and represents yttrium (Y) and/or silicon and/or at least one rare earth element, or hafnium (Hf)). Alloys of this type are known from EP 0 486 489 B1, EP 0 786 017 B1, EP 0 412 397 B1 or EP 1 306 454 A1, which are intended to form part of the present disclosure.

It is also possible for a thermal barrier coating, consisting for example of $ZrO_2$, $Y_2O_3$—$ZrO_2$, i.e. unstabilized, partially stabilized or completely stabilized by yttrium oxide and/or calcium oxide and/or magnesium oxide, to be present on the MCrAlX. Columnar grains are produced in the thermal barrier coating by means of suitable coating processes, such as for example electron beam physical vapor deposition (EB-PVD).

Refurbishment means that after they have been used, protective layers may have to be removed from components 120, 130 (e.g. by sand-blasting). Then, the corrosion and/or oxidation layers and products are removed. If appropriate, cracks in the component 120, 130 are also repaired. This is followed by recoating of the component 120, 130, after which the component 120, 130 can be reused.

The blade or vane 120, 130 may be hollow or solid in form. If the blade or vane 120, 130 is to be cooled, it is hollow and may also have film-cooling holes 418 (indicated by dashed lines).

Figure 5:
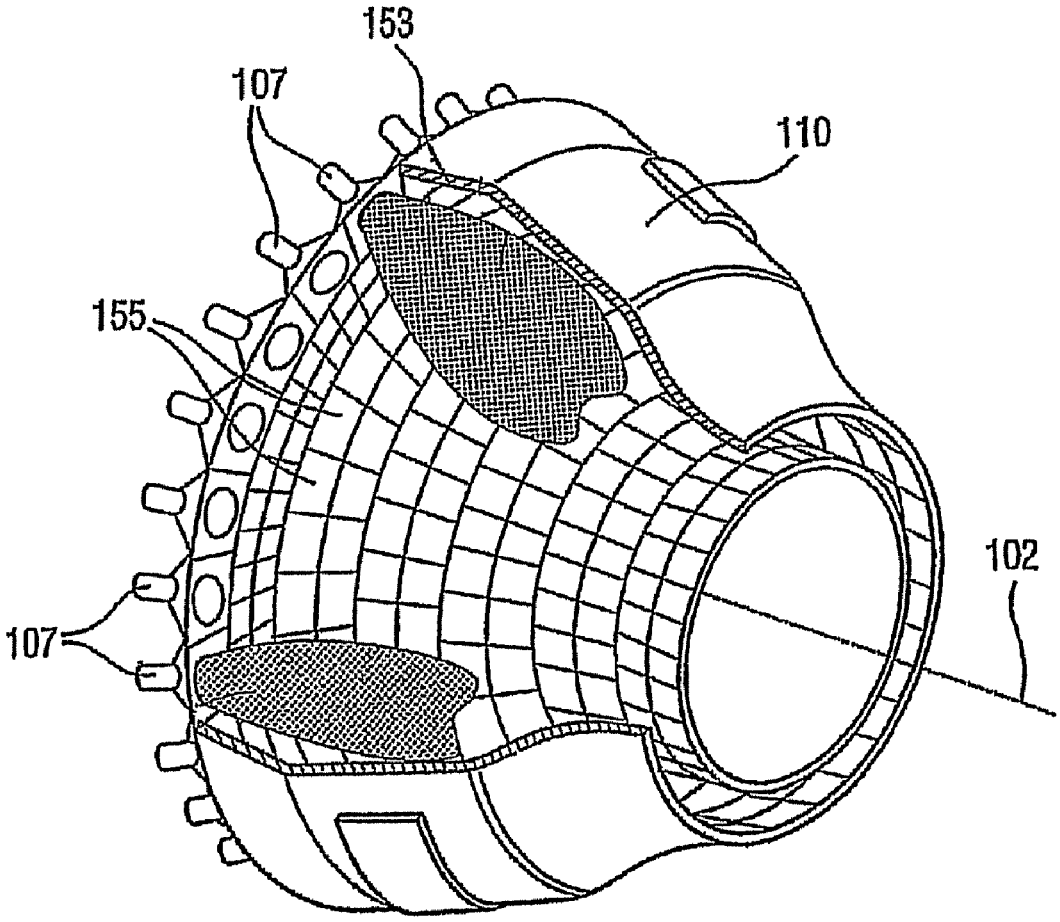
FIG. 5 shows a combustion chamber.

FIG. 5 shows a combustion chamber 110 of a gas turbine. The combustion chamber 110 is configured for example as what is known as an annular combustion chamber, in which a multiplicity of burners 107 arranged around the axis of rotation 102 in the circumferential direction open out into a common combustion chamber space.

For this purpose, the combustion chamber 110 overall is configured as an annular structure positioned around the axis of rotation 102.

To achieve a relatively high efficiency, the combustion chamber 110 is designed for a relatively high temperature of the working medium M of approximately 1000° C. to 1600° C. To allow a relatively long operating time to be achieved even under these operating parameters, which are unfavorable for the materials, the combustion chamber wall 153 is provided, on its side facing the working medium M, with an internal lining formed from heat shield elements 155.

On the working medium side, each heat shield element 155 is provided with a particularly heat-resistant protective layer or is made from material that is able to withstand high temperatures. This may mean solid ceramic bricks or alloys with MCrAlX and/or ceramic coatings. The materials of the combustion chamber wall and their coatings may be similar to the turbine blades or vanes.

Moreover, a cooling system may be provided for the heat shield elements 155 and/or for their holding elements, on account of the high temperatures in the interior of the combustion chamber 110.

The heat shield elements may also have thick-walled regions 16 and can therefore be produced by the process according to the invention.

Figure 6:
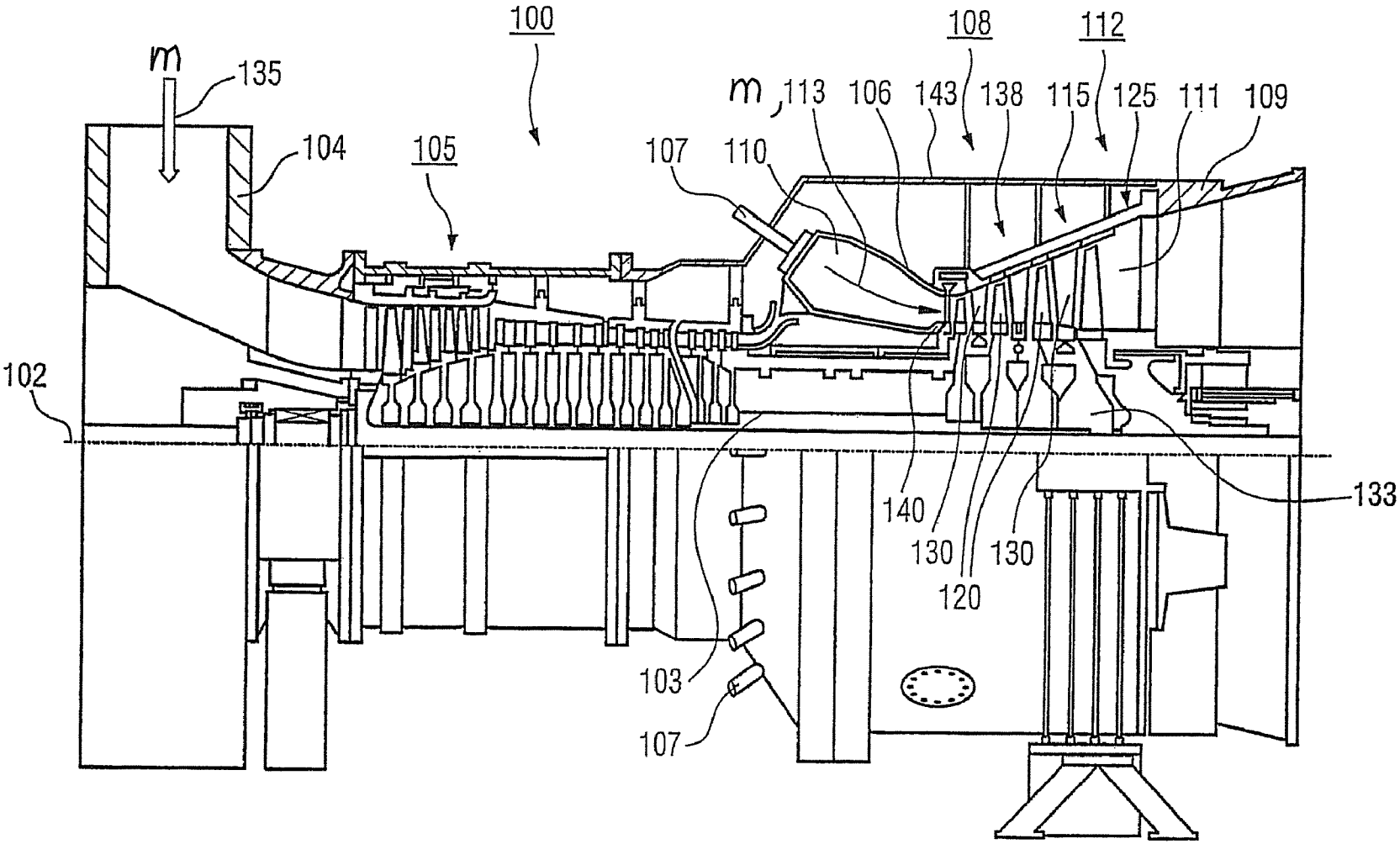
FIG. 6 shows a gas turbine.

FIG. 6 shows, by way of example, a partial longitudinal section through a gas turbine 100. In the interior, the gas turbine 100 has a rotor 103 which is mounted such that it can rotate about an axis of rotation 102 and is also referred to as the turbine rotor. An intake housing 104, a compressor 105, a, for example, toroidal combustion chamber 110, in particular an annular combustion chamber 106, with a plurality of coaxially arranged burners 107, a turbine 108 and the exhaust-gas housing 109 having for example thick-walled regions 16 follow one another along the rotor 103. The annular combustion chamber 106 is in communication with a, for example, annular hot-gas passage 111, where, by way of example, four successive turbine stages 112 form the turbine 108. Each turbine stage 112 is formed, for example, from two blade or vane rings. As seen in the direction of flow of a working medium 113, in the hot-gas passage 111 a row of guide vanes 115 is followed by a row 125 formed from rotor blades 120.

The guide vanes 130 are secured to an inner housing 138 (having for example thick-walled regions 16) of a stator 143, whereas the rotor blades 120 of a row 125 are fitted to the rotor 103 for example by means of a turbine disk 133.

A generator (not shown) is coupled to the rotor 103.

While the gas turbine 100 is operating, the compressor 105 sucks in air 135 through the intake housing 104 (having for example thick-walled regions 16) and compresses it. The compressed air provided at the turbine-side end of the compressor 105 is passed to the burners 107, where it is mixed with a fuel. The mix is then burnt in the combustion chamber 110, forming the working medium 113. From there, the working medium 113 flows along the hot-gas passage 111 past the guide vanes 130 and the rotor blades 120. The working medium 113 is expanded at the rotor blades 120, transferring its momentum, so that the rotor blades 120 drive the rotor 103 and the latter in turn drives the generator coupled to it.

While the gas turbine 100 is operating, the components which are exposed to the hot working medium 113 are subject to thermal stresses. The guide vanes 130 and rotor blades 120 of the first turbine stage 112, as seen in the direction of flow of the working medium 113, together with the heat shield bricks which line the annular combustion chamber 106, are subject to the highest thermal stresses. To be able to withstand the temperatures which prevail there, they can be cooled by means of a coolant. Substrates of the components may likewise have a directional structure, i.e. they are in single-crystal form (SX structure) or have only longitudinally oriented grains (DS structure). By way of example, iron-base, nickel-base or cobalt-base superalloys are used as material for the components, in particular for the turbine blade or vane 120, 130 and components of the combustion chamber 110. Superalloys of this type are known, for example, from EP 1 204 776 B1, EP 1 306 454, EP 1 319 729 A1, WO 99/67435 or WO 00/44949; these documents form part of the disclosure.

The blades or vanes 120, 130 may also have coatings which protect against corrosion (MCrAlX; M is at least one element selected from the group consisting of iron (Fe), cobalt (Co), nickel (Ni), X is an active element and represents yttrium (Y) and/or silicon and/or at least one rare earth element or hafnium). Alloys of this type are known from EP 0 486 489 B1, EP 0 786 017 B1, EP 0 412 397 B1 or EP 1 306 454 A1, which are intended to form part of the present disclosure.

A thermal barrier coating, consisting for example of $ZrO_2$, $Y_2O_3$—$ZrO_2$, i.e. unstabilized, partially stabilized or completely stabilized by yttrium oxide and/or calcium oxide and/or magnesium oxide, may also be present on the MCrAlX. Columnar grains are produced in the thermal barrier coating by suitable coating processes, such as for example electron beam physical vapor deposition (EB-PVD). The guide vane 130 has a guide vane root (not shown here), which faces the inner housing 138 of the turbine 108, and a guide vane head which is at the opposite end from the guide vane root. The guide vane head faces the rotor 103 and is fixed to a securing ring 140 of the stator 143.

Figure 7:
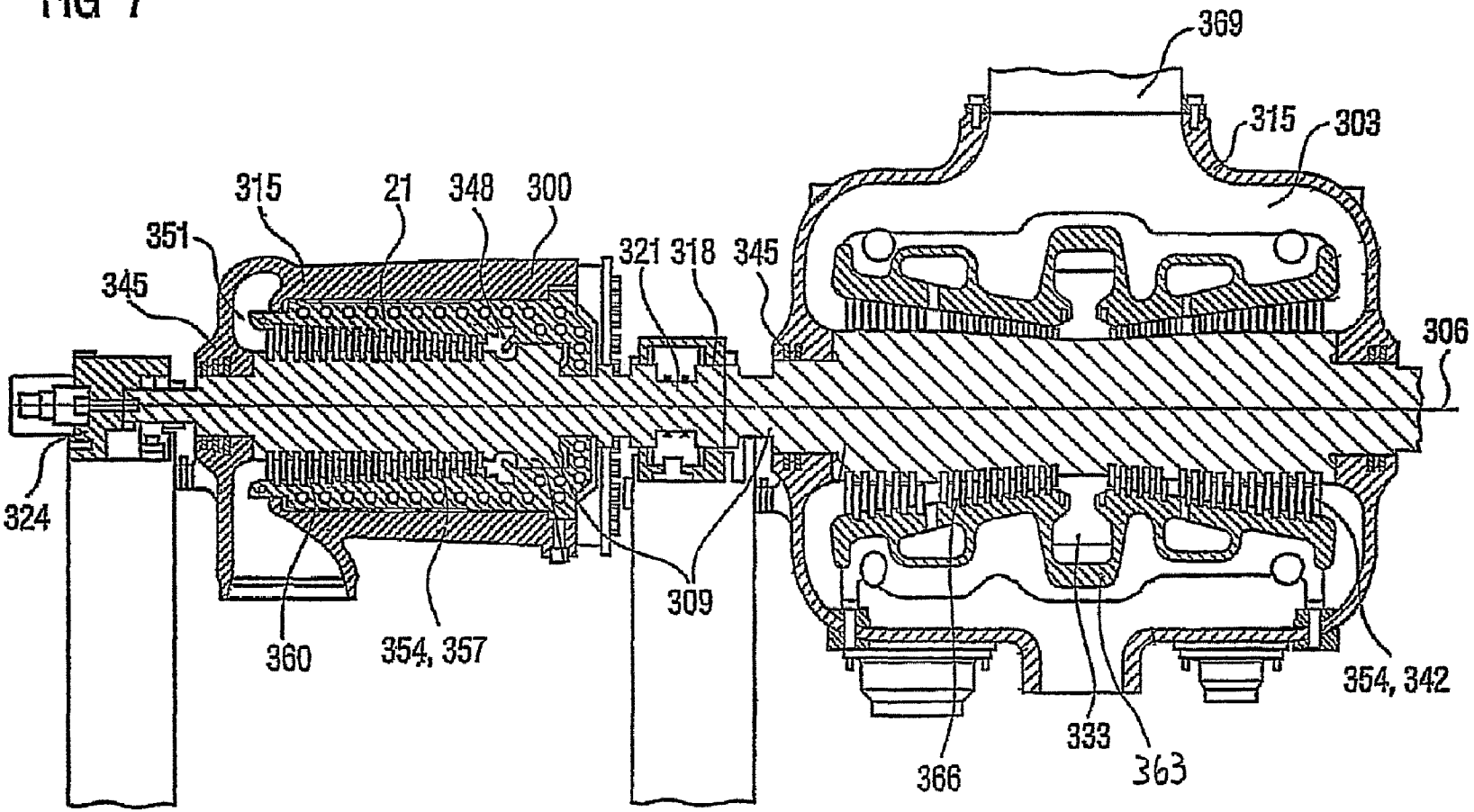
FIG. 7 shows a steam turbine.

FIG. 7 illustrates, by way of example, a steam turbine 300, 303 with a turbine shaft 309 extending along an axis of rotation 306. The steam turbine has a high-pressure part-turbine 300 and an intermediate-pressure part-turbine 303, each with an inner casing 21 (having for example thick-walled regions 16) and an outer casing 315 (having for example thick-walled regions 16) surrounding it. The high-pressure part-turbine 300 is, for example, of pot-type design. The intermediate-pressure part-turbine 303 is of two-flow design.

It is also possible for the intermediate-pressure part-turbine 303 to be of single-flow design. Along the axis of rotation 306, a bearing 318 is arranged between the high-pressure part-turbine 300 and the intermediate-pressure part-turbine 303, the turbine shaft 309 having a bearing region 321 in the bearing 318. The turbine shaft 309 is mounted on a further bearing 324 next to the high-pressure part-turbine 300. In the region of this bearing 324, the high-pressure part-turbine 300 has a shaft seal 345. The turbine shaft 309 is sealed with respect to the outer casing 315 having for example thick-walled regions 16 of the intermediate-pressure part-turbine 303 by two further shaft seals 345. Between a high-pressure steam inflow region 348 and a steam outlet region 351, the turbine shaft 309 in the high-pressure part-turbine 300 has the high-pressure rotor blading 354, 357. This high-pressure rotor blading 354, 357, together with the associated rotor blades (not shown in more detail), constitutes a first blading region 360. The intermediate-pressure part-turbine 303 has a central steam inflow region 333. Assigned to the steam inflow region 333 the turbine shaft 309 has a radially symmetrical shaft shield 363, a cover plate, on the one hand for dividing the flow of steam between the two flows of the intermediate-pressure part-turbine 303 and also for preventing direct contact between the hot steam and the turbine shaft 309. In the intermediate-pressure part-turbine 303, the turbine shaft 309 has a second blading region 366 comprising the intermediate-pressure rotor blades 354, 342. The hot steam flowing through the second blading region 366 flows out of the intermediate-pressure part-turbine 303 from an outflow connection piece 369 to a low-pressure part-turbine (not shown) which is connected downstream in terms of flow.

The invention claimed is:

1. A casting process, comprising:

providing a casting mold defining a shape of a component comprising a thick-walled region with a wall thickness (b) of at least 200 mm;

providing an unmelted solidification control element within a melt in the thick-walled region at a location subdividing a thickness of the thick walled region (b) into smaller contiguous thicknesses ($b_1$ and $b_2$), wherein the component is formed from the melt and the solidification control element is at least of a similar type of material as the melt and becomes part of an interior of the thick-walled region of the component, wherein the control element removes heat directly from interior melt present in the interior of the thick-walled region during cooling of the melt and is thereby effective to directly increase a rate of the cooling of the interior melt present in the thick-walled region of the melt to maintain a desired microstructure throughout the thickness of the thick-walled region of the component.

2. The casting process as claimed in claim 1, wherein the solidification control element is positioned into the melt at a location where, after solidification of the melt, all of the solidification control element is removed from the component during a subsequent machining of the component.

3. The casting process as claimed in claim 1, wherein the melt is a gray cast iron melt, and the solidification control element is effective to cool the thick-walled region of the melt to form a homogenous modular graphite formation within the thick-walled region of the component.

4. The casting process as claimed in claim 1, wherein the solidification control element is actively cooled during cooling of the melt.

5. The casting process as claimed in claim 1, wherein the solidification control element comprises a cylindrical shape having a solid cross-section.

6. A casting process, comprising:

providing an unmelted solidification control element in a melt within a thick-walled portion of a casting mold, wherein a component is formed from the melt upon cooling and solidification of the melt and includes the solidification control element, wherein the control element is substantially surrounded by the solidified melt, wherein the solidification control element removes heat directly from interior melt present in the thick-walled portion of the melt during cooling to directly increase a cooling rate of the interior melt present in the thick-walled portion in order to control a mechanical characteristic of the solidified thick-walled portion of the component; and positioning the solidification control element in the melt at a location where, after solidification of the melt, all of the material of the solidification control element is removed from the component during a subsequent machining of the component, thereby reducing a risk of defects being introduced into the component as a result of bonding defects or inadequate melting of the solidification control element during solidification of the melt.

7. The casting process as claimed in claim 6, further comprising cooling the solidification control element to increase a cooling rate of the thick-walled portion.

8. The casting process as claimed in claim 6, wherein the solidification control element comprises the same elements as the melt.

9. The casting process as claimed in claim 8, wherein the solidification control element material is identical to the melt material.

10. A casting process, comprising:

providing a casting mold defining a shape of a component comprising a thick-walled region having a wall thickness of at least 200 mm;

providing a solidification control element that is unmelted in a melt of similar type material in the casting mold such that the solidification control element is at least partially melted and so that the solidification control element is fully surrounded by interior melt in the thick-walled region, wherein a component is formed from the melt and includes the solidification control element which is fully surrounded by the solidified interior melt in the thick-walled region, wherein the solidification control element is cooled and thereby removes heat directly from the interior melt in the thick-walled region during cooling to directly increase a cooling rate of the interior melt in the thick-walled region to maintain a desired mechanical characteristic of the melt upon solidification.

11. The casting process as claimed in claim 10, wherein the solidification control element is positioned into the melt at a location where, after solidification of the melt, all of the solidification control element is removed from the component during a subsequent machining of the component.

* * * * *